US007168644B2

(12) United States Patent
Togashi et al.

(10) Patent No.: US 7,168,644 B2
(45) Date of Patent: Jan. 30, 2007

(54) JAW CRUSHER AND SELF-PROPELLED CRUSHING MACHINE HAVING THE JAW CRUSHER

(75) Inventors: Ryoichi Togashi, Hirakata (JP); Kouzo Suzuki, Hirakata (JP); Makoto Sugimura, Hirakata (JP)

(73) Assignee: Komatsu Ltd., Tokyo (JP)

( * ) Notice: Subject to any disclaimer, the term of this patent is extended or adjusted under 35 U.S.C. 154(b) by 85 days.

(21) Appl. No.: 10/723,658

(22) Filed: Nov. 25, 2003

(65) Prior Publication Data

US 2004/0129815 A1 Jul. 8, 2004

(30) Foreign Application Priority Data

Nov. 28, 2002 (JP) ..... 2002-346464

(51) Int. Cl.
*B02C 1/04* (2006.01)
*B02C 1/02* (2006.01)

(52) U.S. Cl. ..... 241/268; 241/264; 241/267; 241/269

(58) Field of Classification Search ..... 241/264, 241/268

See application file for complete search history.

(56) References Cited

U.S. PATENT DOCUMENTS

| | | | | |
|---|---|---|---|---|
| 1,620,078 | A * | 3/1927 | Cookinham | 241/268 |
| 2,259,833 | A * | 10/1941 | Thomas | 241/268 |
| 3,918,648 | A * | 11/1975 | Anthony | 241/32 |
| 4,361,289 | A | 11/1982 | Georget et al. | |
| 5,765,769 | A * | 6/1998 | Kaya | 241/264 |
| 6,375,105 | B1 * | 4/2002 | Haven et al. | 241/264 |
| 2002/0036246 | A1 * | 3/2002 | Togashi et al. | 241/101.74 |
| 2004/0124295 | A1 | 7/2004 | Sugimura et al. | |

FOREIGN PATENT DOCUMENTS

| | | | |
|---|---|---|---|
| DE | 199 56 200 | A1 | 6/2001 |
| EP | 0 642 832 | A1 | 3/1995 |
| EP | 0 826 421 | A2 | 3/1998 |
| FR | 1 348 462 | A | 4/1964 |
| GB | 970754 | | 9/1964 |
| JP | 57-110340 | A | 7/1982 |
| JP | 5-45300 | B2 | 7/1993 |
| JP | 3133766 | B2 | 11/2000 |
| WO | WO 02/34393 | A1 | 5/2002 |

* cited by examiner

*Primary Examiner*—Lowell A. Larson
*Assistant Examiner*—Jason Y. Pahng
(74) *Attorney, Agent, or Firm*—Frishauf, Holtz, Goodman & Chick, P.C.

(57) ABSTRACT

A jaw crusher is provided that includes a toggle plate holder mechanism, provided without increasing the overall height thereof, and a reaction force receiver link mechanism of an up-thrust type. A tension link mechanism acts as the toggle plate holder mechanism and includes a link having a tension link, a tension lever, a tension rod, and a tension spring. The layout angle of the tension link and tension rod can be changed freely by the tension lever.

7 Claims, 14 Drawing Sheets

JAW CRUSHER AND SELF-PROPELLED CRUSHING MACHINE HAVING THE JAW CRUSHER

BACKGROUND OF THE INVENTION

1. Field of the Invention

The present invention relates to a jaw crusher which moves a jaw near to and away from the other jaw to crush raw materials and a self-propelled crushing machine having the same.

2. Description of Related Art

There is a known conventional jaw crusher which moves a swing jaw near to and away from a fixed jaw to crush raw materials (for example, refer to published Japanese Patent No. 3133766, pages 5 to 8, FIGS. 1 and 2).

In this jaw crusher, the lower side of the swing jaw is supported by a reaction force receiver mechanism including a toggle plate and a toggle block. A most widely used type of reaction force receiver mechanism is a down-thrust type in which the toggle plate contacts the back of the swing jaw obliquely from upside toward downside. According to this down-thrust type, the swing jaw swings upward from downside when the swing jaw moves near to the fixed jaw.

If a reaction force receiver mechanism having a toggle plate is used, the toggle plate is merely clamped between the toggle block and the swing jaw. This kind of jaw crusher therefore is provided with a toggle plate holder mechanism, which prevents release of the swing jaw from its engagement with the toggle plate while the swing jaw is swinging. The toggle plate holder mechanism has a tension rod whose one end is set on the swing jaw. The tension rod is positioned along the toggle plate. The other end of the tension rod is biased by a tension spring. The biasing force of the tension spring biases the swing jaw to the toggle block side, to clamp the toggle plate.

In the reaction force receiver mechanism of the down-thrust type, the swing jaw moves upward from downside near to the fixed jaw, pressing the fixed jaw. At this time, however, the angle at which the swing jaw moves near to the fixed jaw is so small that raw materials slip on the fixed jaw. This results in a problem that the fixed jaw is worn out in a short time. Hence, another reaction force receiver mechanism of a so-called up-thrust type is known, in which the swing jaw moves near to the fixed jaw when the swing jaw swings downward from upside. In a jaw crusher having this reaction force receiver mechanism, the angle at which the swing jaw moves near to the fixed jaw is so large that raw materials hardly slip between the jaws. Accordingly, the lifetime of the jaws can be extended.

However, in this up-thrust type, the toggle plate contacts the swing jaw obliquely upward from downside due to the structure of the reaction force receiver mechanism. Therefore, if the tension rod and tension spring are positioned along the toggle plate in the above-described manner, ends of the rod and spring protrude into a discharge space below the jaw crusher. This results in a problem that the ends of the tension rod and tension spring interfere with crushed materials being discharged by a discharge conveyer or the like.

In order to prevent the end of the tension rod from protruding in the discharge space, the overall height of the jaw crusher has to be increased. However, in the case that the jaw crusher is mounted on the self-propelled crushing machine, the height thereof can not be increased unlimitedly due to a height limit for transportation purpose.

SUMMARY OF THE INVENTION

The present invention has as an object to provide a jaw crusher of an up-thrust type in which a toggle plate holder mechanism can be installed without increasing the overall height, and a self-propelled crushing machine having the jaw crusher.

A jaw crusher according to the present invention has: a fixed jaw; a swing jaw which swings relative to the fixed jaw; a reaction force receiver mechanism of an up-thrust type including a toggle plate having an end contacting the swing jaw, and a toggle plate support member which another end of the toggle plate contacts; and a toggle plate holder mechanism which holds the toggle plate between the swing jaw and the reaction force receiver mechanism, in which the toggle plate holder mechanism includes a link.

In the jaw crusher constructed in the structure as described above, the toggle plate holder mechanism includes a link, and the structure can be arranged by changing freely the orientation of the link. Accordingly, the freedom of layout of the toggle plate holder mechanism in its height direction is enhanced. As a result, even when a reaction force receiver mechanism of an up-thrust type is adopted, for example, ends of the tension rod and tension spring constituting a biasing portion do not protrude into a discharge space from the frame, so crushed materials can be discharged without problems. In addition, the toggle plate holder mechanism can therefore be installed without changing the overall height. This is advantageous especially for a vehicle-mounted (self-propelled) jaw crusher whose height is restricted.

Desirably in the jaw crusher according to the present invention, the reaction force receiver mechanism has an outlet clearance adjustment mechanism which moves the swing jaw near to and away from the fixed jaw through the toggle plate support member and the toggle plate, and the toggle plate holder mechanism has a biasing portion, which biases the swing jaw and the toggle plate support member to the toggle plate and is attached to the toggle plate support member.

In the jaw crusher constructed in the structure as described above, the outlet clearance between the fixed and swing jaws is adjusted as the swing jaw is moved near to or away from the fixed jaw through the toggle plate support member and the toggle plate, by the outlet clearance adjustment mechanism. As a result, the size of crushed materials can be adjusted so that applicability of the jaw crusher is enhanced.

At this time, the biasing portion of the toggle plate holder mechanism is attached to the toggle plate support member. Therefore, as the toggle plate support member is moved by the outlet clearance adjustment mechanism, the biasing portion of the toggle plate holder mechanism moves accordingly. As a result, the bias applied from the biasing portion to the toggle plate is not changed substantially but is kept substantially constant regardless of the size of the outlet clearance. It is hence unnecessary to adjust the bias when the outlet clearance is adjusted. The operation of adjusting the outlet clearance is simplified.

Desirably in the jaw crusher according to the present invention, the toggle plate holder mechanism includes a tension link having an end attached to the swing jaw, a tension lever supporting another end of the tension link, a tension rod having an end attached to the tension lever, and a tension spring which biases the tension rod in an axial direction of the tension rod, and swing centers at both sides of the tension link are positioned near swing centers at both sides of the toggle plate.

In the jaw crusher constructed in the structure as described above, the tension link swings in accordance with the toggle plate when the swing jaw swings. At this time, the swing centers at both sides of the tension link are provided near the swing centers at both sides of the toggle plate. Therefore, the swing of the tension link is approximate to the swing of the toggle plate. That is, the tension link swings about the vicinity of the swing center on the side of the tension lever, and the position of the link lever does not change substantially. Accordingly, the bias of the tension spring does not change substantially, and hence, the bias is stable while the swing jaw swings.

Desirably in the jaw crusher according to the present invention, the toggle plate holder mechanism includes a tension link having an end attached to the swing jaw, a tension lever supporting another end of the tension link, a tension rod having an end attached to the tension lever, and a tension spring which biases the tension rod in an axial direction of the tension rod, and swing centers at both sides of the tension link are located at the same positions as swing centers at both sides of the toggle plate, when viewed in profile.

In the jaw crusher constructed in the structure as described above, the swing centers at both sides of the tension link are located at the same positions as the swing centers at both sides of the toggle plate, when viewed in profile. Therefore, the toggle plate and the tension link are always kept parallel to each other. While the swing jaw is swinging, the swing of the toggle plate and the swing of the tension link correspond to each other. That is, the tension link swings about the swing center of the toggle plate on the side of the tension lever, so that the position of the tension lever does not change at all. Accordingly, the bias of the tension spring does not change but the bias is constant while the swing jaw is swinging. As a result, the crushing operation can be performed more stably.

Desirably in the jaw crusher according to the present invention, the tension link has a shape having a concave, and a notch is formed, in the toggle plate, at respective positions corresponding to the swing centers at both sides of the tension link.

Conventionally, the toggle plate is provided throughout the overall width of the swing jaw. Therefore, interference with the toggle plate may be caused if the swing centers at both sides of the tension link are located near the swing centers of the toggle plate or at the same positions as the swing centers of the toggle plate, when viewed in profile. In contrast, in the jaw crasher according to the present invention, the tension link is formed in a shape having a concave, and a notch is formed, in the toggle plate, at respective positions corresponding to the swing centers at both sides of the tension link. Therefore, the tension link and the toggle plate do not interfere with each other, but the swing centers of the tension link can be steadily located, with an easy structure, near the swing centers of the toggle plate or at the same positions as the swing centers of the toggle plate, when viewed in profile.

Desirably in the jaw crusher according to the present invention, the toggle plate is divided into plural pieces, at a position where the tension link is provided.

Also in the jaw crusher constructed in this structure, the toggle plate is divided at the position where the tension link is provided. Therefore, the swing centers of the tension link do not interfere with the toggle plate but can be steadily located near the swing centers of the toggle plate or at the same positions as the swing centers of the toggle plate, when viewed in profile.

A self-propelled crushing machine according to the present invention is characterized in that the above-described jaw crusher according to the present invention is mounted on the machine.

On the self-propelled crushing machine constructed in the structure as described above, the jaw crusher as described above is mounted. Therefore, the effects described above can be attained, and the toggle plate holder mechanism is installed without increasing the overall height. This kind of jaw crusher is hence suitably mounted on, especially, a self-propelled crushing machine whose height is limited during transportation. Further, the overall height can be kept short, so that loading ability is improved and reductions in size and weight are promoted.

DETAILED DESCRIPTION OF THE PREFERRED EMBODIMENT(S)

Hereinafter, an embodiment of the present invention will be described on the basis of the drawings.

[Schematic Description of Whole Structure]

Figure 1:
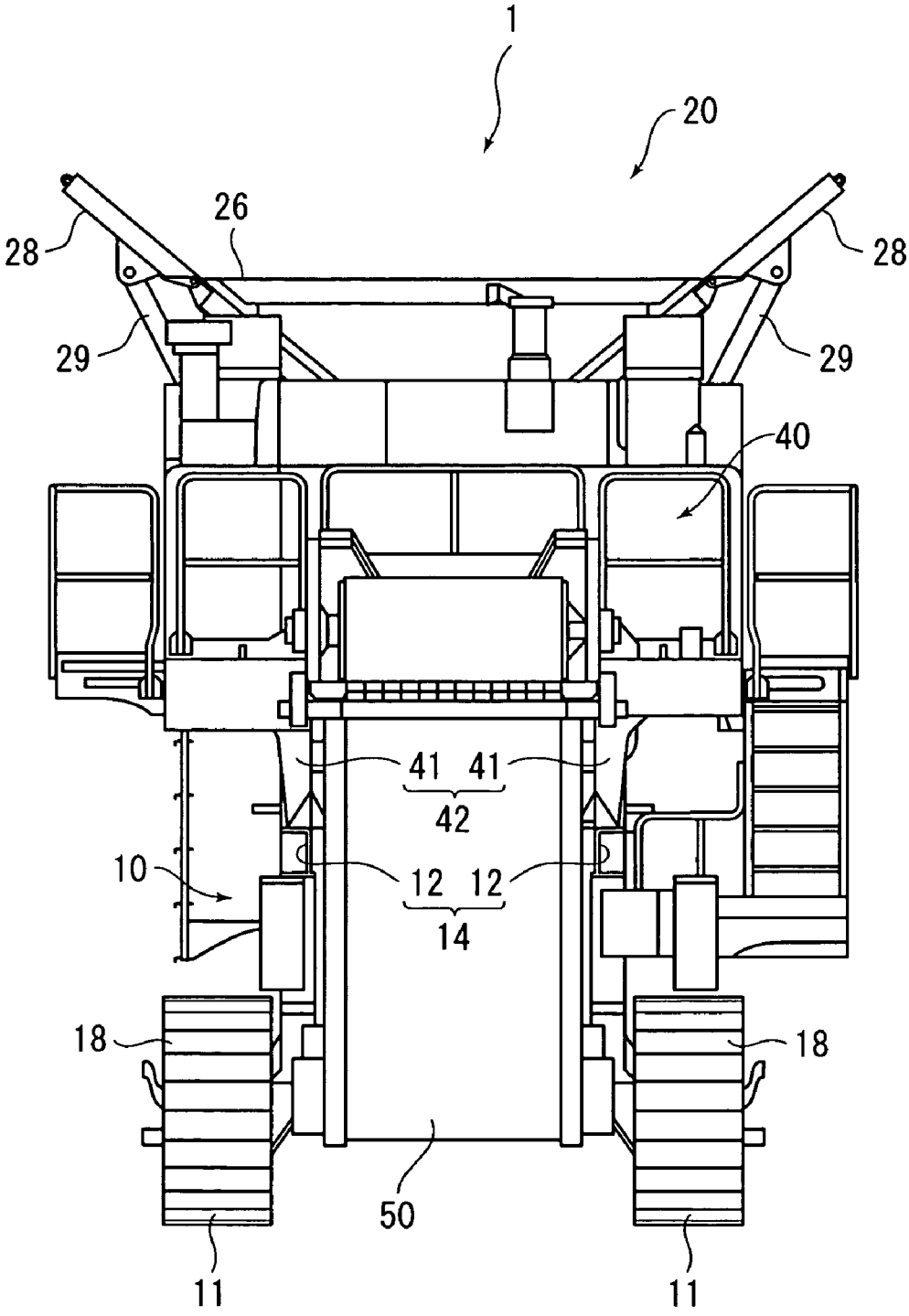
FIG. 1 is a front view showing a self-propelled crushing machine according to an embodiment of the present invention.
Figure 2:
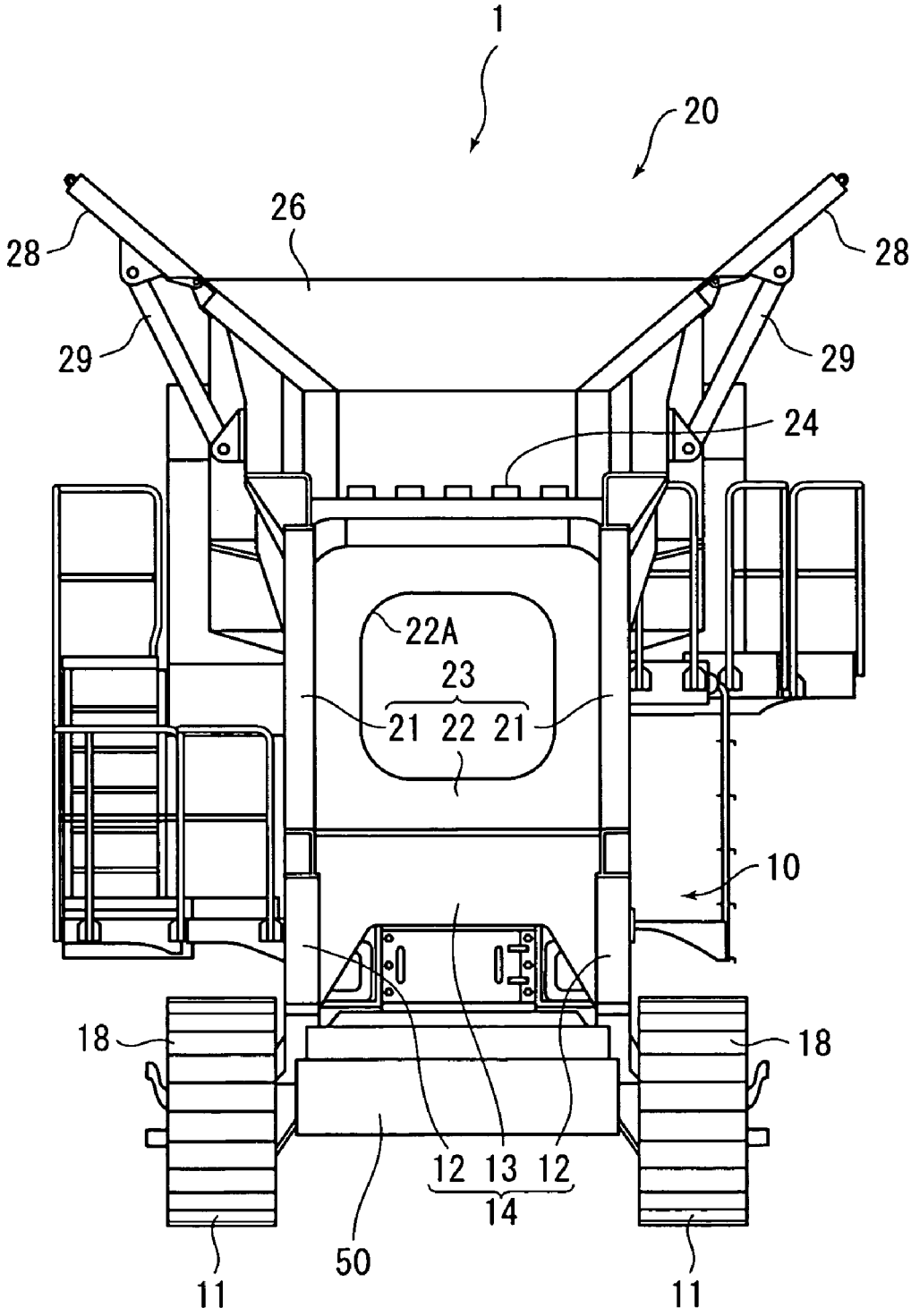
FIG. 2 is a rear view showing the self-propelled crushing machine.
Figure 3:
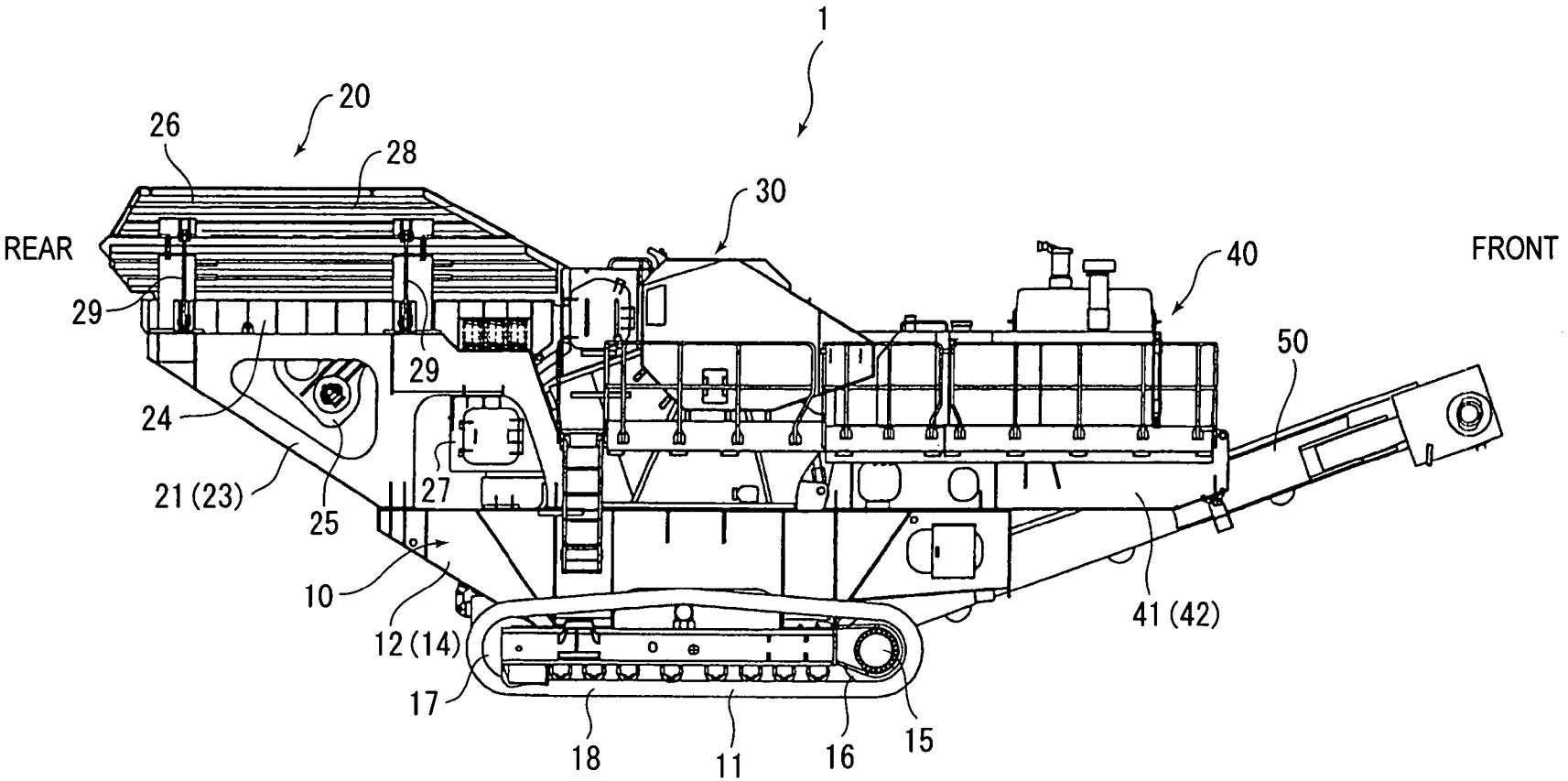
FIG. 3 is a right side view showing the self-propelled crushing machine.
Figure 4:
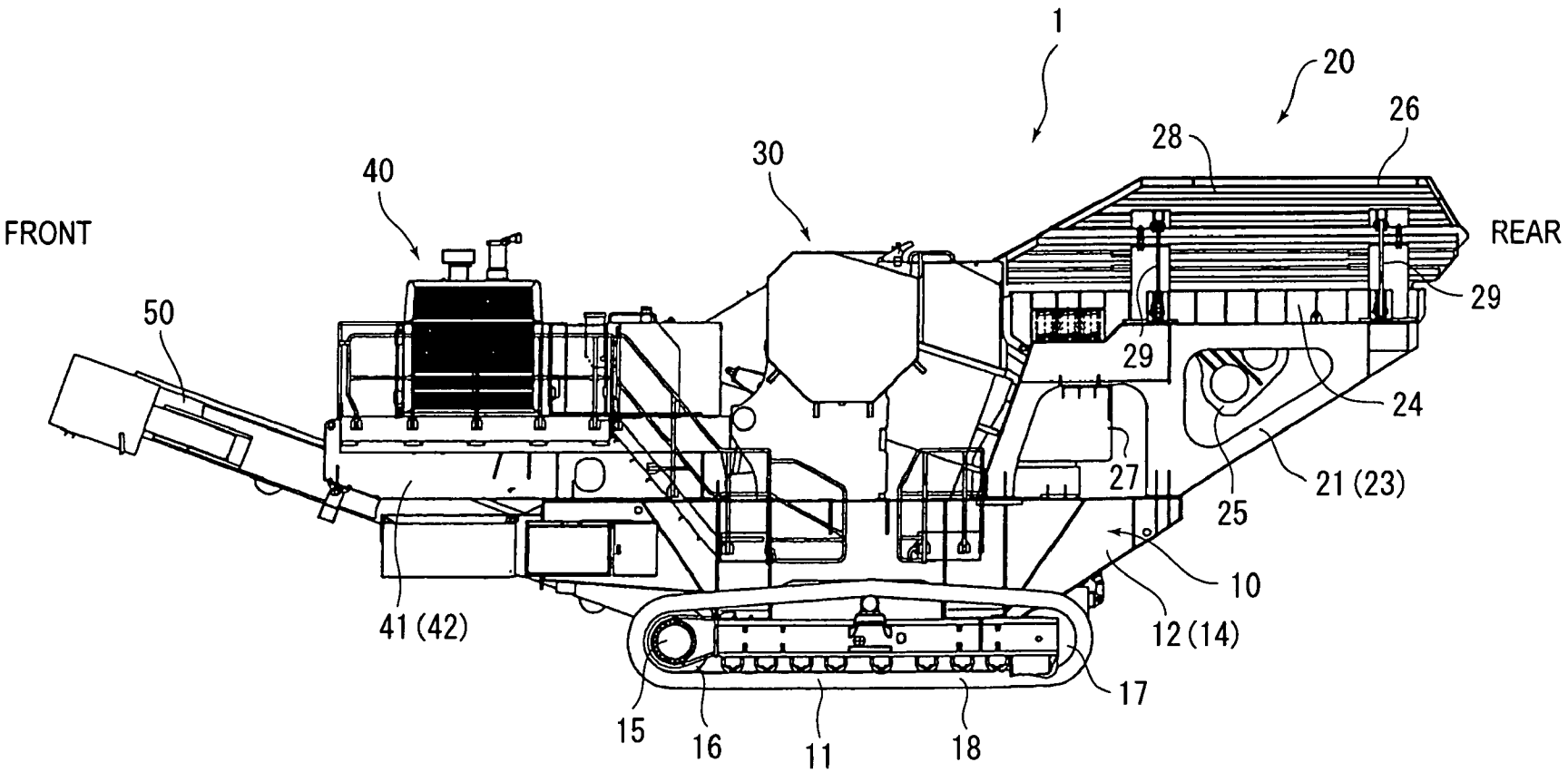
FIG. 4 is a left side view showing the self-propelled crushing machine.
Figure 5:
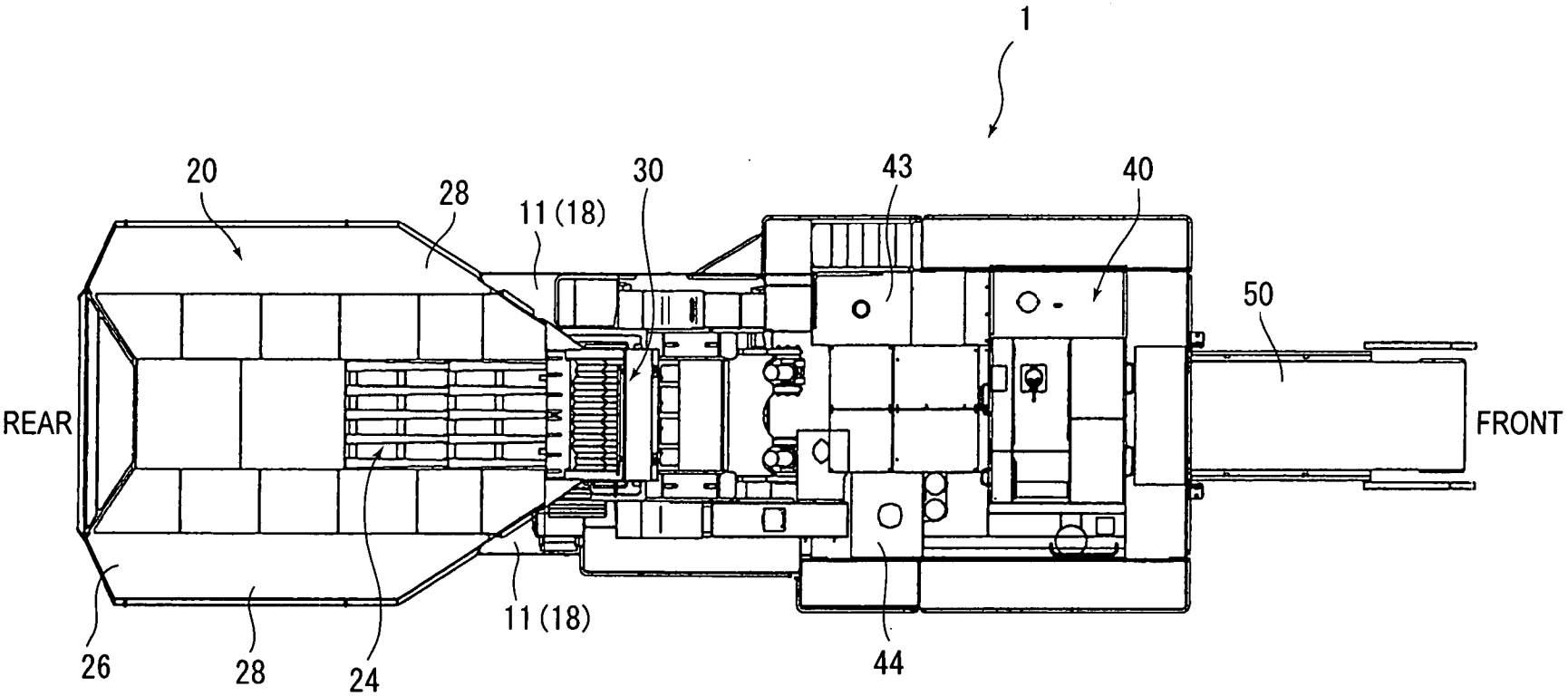
FIG. 5 is a plan view showing the self-propelled crushing machine.

FIGS. 1 to 5 are respectively a front view, rear view, right side view, left side view, and plan view of a self-propelled crushing machine according to a present embodiment. In the present embodiment, the right side in FIG. 3 is referred to as the front side of the structure, as well as the left side as the rear side, for the sake of conveniences in explanation.

A self-propelled crushing machine 1 may be used to crush concrete lumps and asphalt lumps at a building demolition site or the like. In case of the present embodiment, however, the machine is used exclusively to crush coarsely big rocks and fieldstones into predetermined grain sizes at a mine, quarry, or the like. Therefore, the machine in this embodiment is large in each of overall length, width, and height, and classified into a large-scale self-propelled crushing machine.

This self-propelled crushing machine 1 includes a main unit 10 having a pair of lower traveling members 11, a feed unit 20 mounted in the rear of the main unit 10 and supplied with raw materials, a jaw crusher 30 mounted in the front of the feed unit 20, a power unit 40 further mounted in the front of the jaw crusher 30, and a discharge conveyor 50 extending obliquely upward in a frontward direction from between a pair of crawlers 18 below the main unit 10.

The main unit 10 has a main frame (track frame) 14 consisting of left and right side frames 12 each continuous in the longitudinal direction and plural link frames 13 (FIG. 2) linking the side frames to each other. The lower traveling members 11 are respectively assembled on the lower sides of the side frames 12. Each lower traveling member is constructed in a structure in which a crawler 18 is wound around a front sprocket 16 driven by a hydraulic motor 15 and a rear idler 17.

The feed unit 20 has a rear frame 23 in which left and right side frames 21 protruding rearward are linked to each other by a substantially rectangular link frame 22 having an opening 22A. A grizzly feeder 24 is set above the rear frame 23 with plural coil springs inserted therebetween. The grizzly feeder 24 is driven by a vibrator 25. A hopper 26 is provided above the grizzly feeder 24, covering the feeder from its three sides. Raw materials are thrown into the hopper 26 whose opening widens upward. Provided below the grizzly feeder 24 is a discharge chute 27 which guides raw materials sorted and dropped by a grizzly to the discharge conveyor 50 below. In the hopper 26 of the present embodiment, the left and right wings 28 are provided to be foldable relative to the main body, and can be folded downward by releasing the upper end of the support bars 29. Consequently, the overall height of the feed unit 20 becomes short, restriction of the transportation by a trailer can be satisfied.

Figure 6:
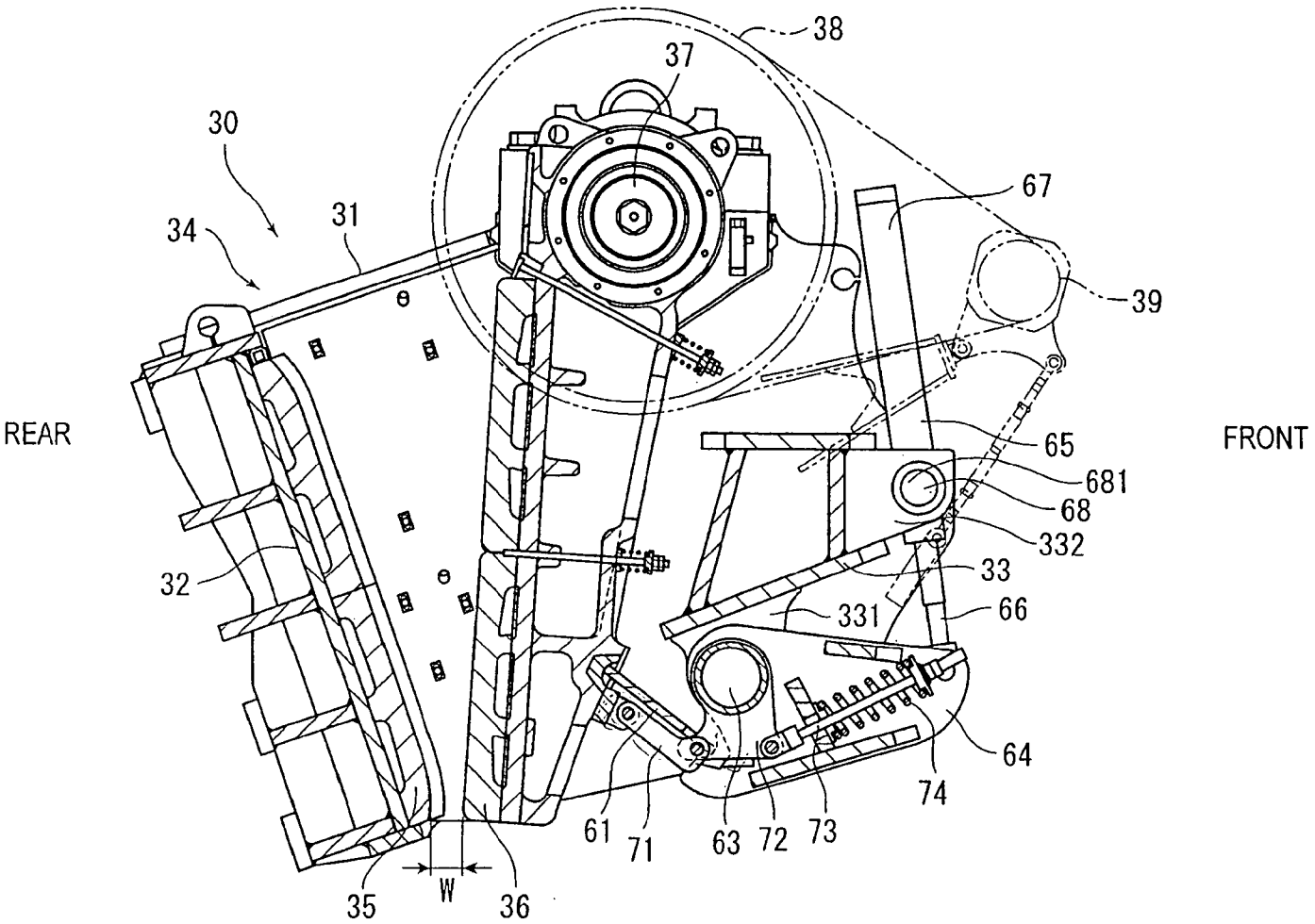
FIG. 6 is a sectional view showing a jaw crusher of the self-propelled crushing machine.

As shown in FIG. 6, the jaw crusher 30 has a crusher frame 34 in which left and right side wall plates 31 are linked to each other by a rear wall plate 32 and a cross member 33. The rear wall plate 32 is reinforced by plural ribs. A fixed jaw 35 is attached to the inside of the rear wall plate 32. A swing jaw 36 whose tooth surface stands substantially vertically is provided in the front of the fixed jaw 35. The swing jaw 36 hangs, at an upper side thereof, on an eccentric part of a main shaft 37 which is rotatably bridged between the side wall plates 31. The swing jaw 36 is also supported, at a lower side thereof, by a reaction force receive link mechanism (reaction force receiver mechanism) which receives reaction force generated by crushing. Further, a tension link mechanism (toggle plate holder mechanism) constantly biases the swing jaw 36 to the reaction force receive link mechanism.

The reaction force receive link mechanism substantially includes a toggle plate 61 having an end engaged on a rear part of the swing jaw 36, toggle links (toggle plate support members) 64 which support the other end of the toggle plate 61 and rotate about the link pin 63 as a rotation center thereof, and bear lock cylinders 65 having lower ends pivoted on the toggle links 64. Each bear lock cylinder 65 is rotatably pivoted on the side of the cross member 33 (trunnion structure). Further, the rod 66 of each bear lock cylinder 65 is extended and retracted so that an outlet clearance W between the lower ends of the jaws 35 and 36 can be adjusted. That is, the reaction force receive link mechanism serves as an outlet clearance adjustment link mechanism (outlet clearance adjustment mechanism) which moves the swing jaw 36 near to and away from the fixed jaw 35 through the toggle links 64 and the toggle plate 61 by driving the bear lock cylinders 65.

The tension link mechanism is positioned at the substantial center of the reaction force receive link mechanism. The tension link mechanism substantially includes a tension link 71 having an end pivoted on the side of the swing jaw 36, a tension lever 72 rotatably pivoted on a fixed link pin 63, a tension rod 73 having an end pivoted on the tension lever 72, and a tension spring (biasing portion) 74 which biases the tension rod 73 in a predetermined direction. The tension rod 73 and the tension spring 74 are assembled on the toggle links 64.

In the jaw crusher 30 as described above, a pulley 38 provided at an end of a main shaft 37 is driven by a hydraulic motor 39 through a V-belt. With the rotation of the main shaft 37, the swing jaw 36 functions as a swinging link and crushes raw materials between the swing jaw 36 and the fixed jaw 35. At this time, in the jaw crusher 30 according to the present embodiment, the reaction force receive link mechanism adopts the up-thrust type, so that the swing jaw 36 swings downward from upside as if the tooth surface of the fixed jaw 35 is scraped.

The power unit 40 has a base frame 42 in which left and right side frames 41 are linked to each other by plural link frames (not shown). An engine, hydraulic pump, fuel tank 43, operating oil tank 44, and the like are mounted on the base frame 42 with use of appropriate mount brackets and cross members. A control valve is contained in a container space surrounded by base frame 42. The control valve distributes the hydraulic pressure of the hydraulic pump to the hydraulic motor for the lower traveling members 11, a vibrator 25 of the grizzly feeder 24, the hydraulic motor 39 of the jaw crusher 30, a hydraulic motor for driving the discharge conveyor 50, and the like.

A rear part of the discharge conveyor 50 is positioned in the rear of the discharge port at the lower end of the discharge chute 27. The discharge conveyor 50 discharges frontward uncrushed raw materials discharged from the chute 27 and crushed materials dropped from the outlet of the jaw crusher 30, to drop and accumulate those materials from a height. If foreign materials such as rebar, metal strips, and the like are contained in raw materials, a magnetic ore separator may be mounted in the front of the discharge conveyor 50 to remove those foreign materials. In place of accumulating crushed materials from the discharge conveyor 50 on the ground, crushed materials may be conveyed to a remote place by secondary and tertiary conveyors or the like.

[Details of Jaw Crusher]

Details of the jaw crusher 30 will now be described.

In FIG. 6, the jaw crusher 30 has the fixed jaw 35 fixed to the rear wall plate 32, and the swing jaw 36 which swings relative to the fixed jaw 35, as described above. Provided on the rear surface of the swing jaw 36 are the reaction force receive link mechanism which receives reaction force from the swing jaw 36, and the tension link mechanism which biases the swing jaw 36 with a predetermined bias toward the reaction force receive link mechanism.

The reaction force receive link mechanism includes a link having the toggle plate 61, toggle links 64, and bear lock cylinders 65, as described above.

Figure 7:
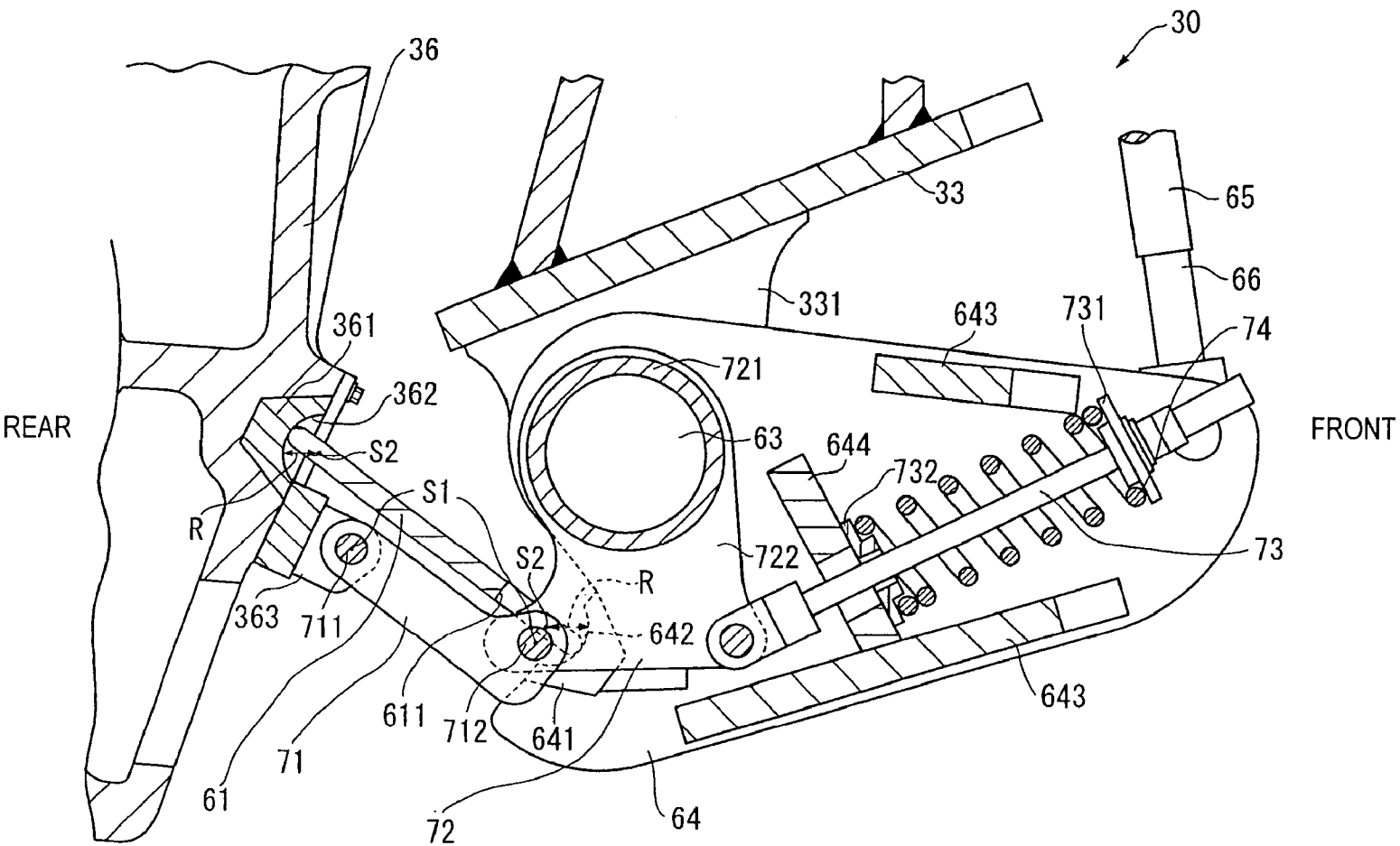
FIG. 7 is an enlarged sectional view showing a toggle plate holder mechanism of the jaw crusher.
Figure 8:
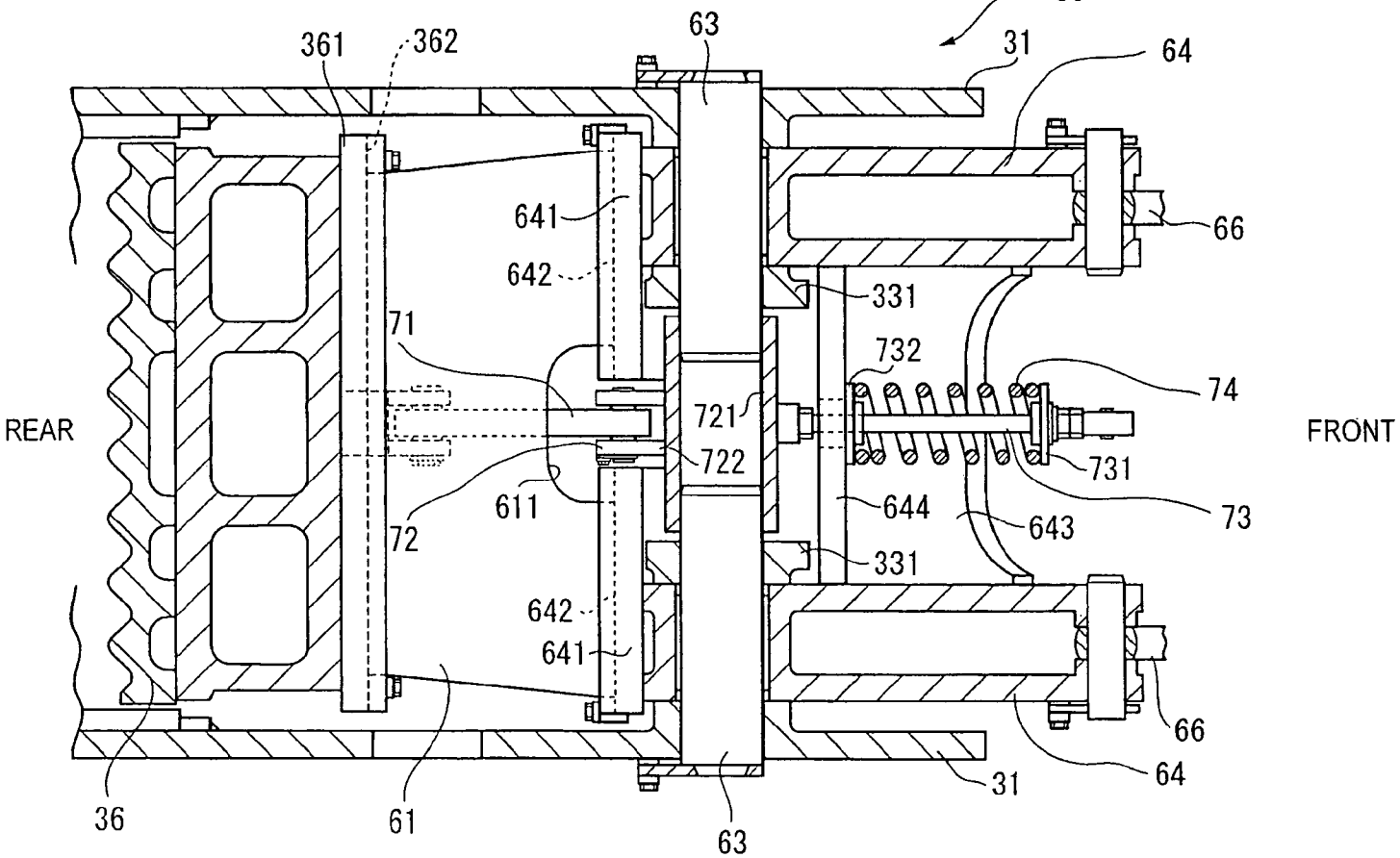
FIG. 8 is a plane sectional view showing a toggle plate holder mechanism of the jaw crusher.

As shown in FIGS. 7 and 8, the toggle plate 61 is a plate-like member which contacts the rear surface of the swing jaw 36 throughout the overall width of the jaw 36. The toggle plate 61 contacts the swing jaw 36 in an oblique upward direction from downside, so that the reaction force receive link mechanism is of the up-thrust type. An end of the toggle plate 61 contacts a contact portion 361 provided on the rear surface of the swing jaw 36. The other end of the toggle plate 61 contacts contact portions 641 provided on the toggle links 64. Thus, the toggle plate 61 is sandwiched between the swing jaw 36 and the toggle links 64. Concave portions 362 and 642 each having a substantially arc-like section with a radius R indicated by an arrow in FIG. 7 are formed on the contact portions 361 and 641. The toggle plate 61 can swing about swinging centers S2 which are the centers of the arcs of the concave portions 362 and 642. In the width-directional center of the toggle plate 61, a notch 611 is formed on the side close to the toggle links 64.

Two toggle links 64 are provided inside and near the side wall plates 31, and are linked to each other by a link portion 643 integrally bridged between the toggle links 64. A mount portion 644 to which the tension spring 74 is attached is integrally formed on the link portion 643. These toggle links 64 are each pivoted on a fixed link pin 63. Two fixed link pins 63 are provided coaxially with each other inside the side wall plates 31. First ends of these pins, which are far from each other, are fixed to the side wall plates 31. Second ends of the pins, which are close to each other, are fixed to a mount plate 331 protruding downward from the cross member 33.

The toggle links 64 are respectively provided with the contact portions 641 described above. End portions of the toggle plate 61, on both sides of the notch 611, contact the contact portions 641, respectively.

The bear lock cylinders 65 are respectively provided in the front of the two toggle links 64. As shown in FIG. 6, each bear lock cylinder 65 has the rod 66 and a cylinder body 67 for extending and retracting the rod 66. Each bear lock cylinder 65 is arranged to stand with the rod 66 situated in the lower side of the cylinder body 67. The lower ends of the rods 66 are respectively pivoted on the front ends of the toggle links 64. A portion of each cylinder body 67 near the end thereof through which the rod 66 extends and retracts, i.e., the lower side (head side) of the cylinder body is rotatably supported by a support portion 68 of the trunnion structure. This support portion 68 has a support shaft 681 integrally formed on and protruding from both sides of the cylinder body 67, and a bearing portion not shown but supporting rotatably the support shaft 681. An end of the support shaft 681 is pivoted on one of the side wall plates 31. The other end of the support shaft 681 is pivoted on the mount plate 332 protruded from the cross member 33. Thus, the bear lock cylinders 65 are positioned near the side wall plates 31.

In each of these bear lock cylinders 65, the rod 66 or the piston at an end of the rod 66 interference-fits the cylinder body 67, and both of the rod and the cylinder body 67 are usually locked. If hydraulic pressure is applied to the interference-fitting portions through the rods 66, the circumferential walls of the cylinder bodies 67 expand, reducing resistance between the cylinder bodies 67 and the rods 66. The lock is then released so that the rods 66 can extend and retract relative to the cylinder bodies 67. Therefore, the rods 66 can be locked at arbitrary positions in the cylinder bodies 67.

According to this reaction force receive link mechanism, the reaction force generated when raw materials are crushed is received by the fixed link pin 63 of the toggle links 64 and the support portions 68 of bear lock cylinders 65 through the toggle plate 61. If, as described above, hydraulic pressure is applied between the pistons of the bear lock cylinders 65 and the cylinder bodies 67 to release the lock and if the rods 66 are extended and retracted, the swing jaw 36 is moved near to and away from the fixed jaw 35 by the toggle links 64 and the toggle plate 61. That is, the reaction force receive link mechanism also functions as the outlet clearance adjustment link mechanism.

The tension link mechanism is provided at the substantial center in the width direction of the swing jaw, between two toggle links 64 as shown in FIGS. 7 and 8. The tension link mechanism is a link mechanism having the tension link 71, tension lever 72, tension rod 73, and tension spring 74, as described above.

The tension link 71 is substantially L-shaped. An end of the tension link 71 is pivoted on a rotation center shaft 711 of a mount portion 363 provided on the swing jaw 36. The other end of the tension link 71 is pivoted on a rotation center axis 712 of the tension lever 72. The tension link 71 can therefore swing about the substantial centers of the rotation center shafts 711 and 712, as swing centers S1. That end of the tension link 71, which is close to the tension lever 72, is positioned inside the notch 611 of the toggle plate 61, so that the tension link might not interfere with the toggle plate 61.

The swing centers S1 are arranged near the swing centers S2 of the toggle plate 61, so that the swing of the tension link 71 is approximate to the swing of the toggle plate 61.

The tension lever 72 has a shaft portion 721 rotatably supported by the fixed link pins 63, and lever portions 722 which rotate about the shaft portion 721. The shaft portion 721 is formed in a cylindrical shape having two ends supported between those ends of the fixed link pins 63 that are close to each other. A pair of lever portions 722 are provided vertically below the shaft portion 721. The tension link 71 is set on a rear lower end of the lever portion 722, and an end of the tension rod 73 is set on a front lower end of the lever portion 722.

The tension rod 73 penetrates the mount portion 644 of the toggle links 64, and is arranged in an obliquely upward direction to the front side from the mount portion of the tension lever 72. The tension rod 73 is inserted in the tension spring 74. The tension spring 74 has a top end contacting a contact portion 731 screwed on the tension rod. The bottom end of the tension spring is made contact a contact portion 732 fixed to the mount portion 644. Thus, the tension spring 74 biases the tension rod 73 to the toggle links 64 with a predetermined bias (tension). Specifically, the tension spring 74 biases the swing jaw 36 to the toggle links 64 through the tension rod 73, tension lever 72, and tension link 71. This biasing steadily holds the toggle plate 61 between the swing jaw 36 and the toggle links 64.

[Operation of Jaw Crusher]

Hereinafter, the operation of the jaw crusher 30 will be explained.

At first, the hydraulic motor 39 is driven to rotate the pulley 38 through the V-belt and further the main shaft 37. The swing jaw 36 pivoted on the eccentric part of the main shaft 37 then swings. At this time, the toggle plate 61 swings about the swing center S2 at the side of the toggle links 64 because the swing jaw 36 is supported at its lower side by the reaction force receive link mechanism of the up-thrust type. Accordingly, the swing jaw 36 swings to move near to and away from the fixed jaw. By this swinging action, the swing jaw 36 and the fixed jaw 35 crush raw materials thrown between both jaws, and discharge crushed materials to the discharge conveyor 50 from the outlet clearance W between the lower ends.

Further, the reaction force generated when the swing jaw 36 crushes raw materials is received by the fixed link pin 63 of the toggle links 64 and the support portions 68 of the bear lock cylinders 65. If the reaction force received by the swing jaw 36 is too large, the interference-fitting portions of the bear lock cylinders 65 slide to prevent damages on the toggle links 64 and the bear lock cylinders 65.

Meanwhile, to change the grain size of crushed materials, the outlet clearance adjustment link mechanism is operated. Hydraulic pressure is applied between the pistons of the bear lock cylinders 65 and the cylinder bodies 67, so that the cylinder bodies 67 are slightly expanded to reduce resistance between them. The lock depending on the interference-fit is thus released. In this state, hydraulic pressure is applied to the side of the heads of the cylinder bodies 67 or to the side of the bottoms, to extend and retract the rods 66. Accordingly, the toggle links 64 rotate about the fixed link pin 63. The toggle plate 61 then moves so that the swing jaw 36 moves near to or away from the fixed jaw 35. The outlet clearance W between the lower ends of the swing jaw 36 and the fixed jaw 35 is thus adjusted to change the grain size of the crushed materials.

At this time, in the tension link mechanism, the tension link 71 moves and the tension lever 72 rotates, as the swing jaw 36 moves near to and away from the fixed jaw 35. Also at this time, the swing centers S1 of the tension link 71 are respectively near the swing centers 52 of the toggle plate 61. The rotation centers of the tension lever 72 and the toggle links 64 are the common fixed link pin 63. Therefore, the trajectory of the tension link 71 is approximate to the trajectory of the toggle plate 61. The tension lever 72 accordingly rotates by an angle substantially equal to the rotation angle of the toggle links 64. As a result, the contact portion 731 of the tension rod 73 attached to the tension lever 72 and the contact portion 732 fixed to the mount portion 644 of the toggle links 64 does not substantially change their positions relative to each other. The bias of the tension spring 74 is kept substantially constant even when the outlet clearance W is changed.

[Advantages of the Embodiment]

The following advantages are obtained from the above embodiment.

(1) The tension link mechanism constitutes a link having the tension link 71, tension lever 72, tension rod 73, and tension spring 74. Therefore, the layout angles of the tension link 71 and the tension rod 73 at the tension lever 72 can be changed so that the freedom of layout in the height direction can be enhanced. Accordingly, the tension rod 73 can be positioned obliquely upward in a frontward direction. Therefore, the tension rod 73 and the tension spring 74 do not protrude toward the discharge conveyor 50 below the swing jaw 36, and crushed materials can be discharged excellently.

On the contrary, even in the jaw crusher including the reaction force receive link mechanism of the up-thrust type, the tension link mechanism can be positioned without increasing the overall height. Hence, the height limit is surely satisfied even when the jaw crusher 30 is mounted on a self-propelled crushing machine 1.

(2) The tension spring 74 is held between the top end of the tension rod 73 and the mount portion 644 of the toggle links 64, by the contact portions 731 and 732. As a result, the toggle links 64 rotate and the swing jaw 36 moves, to adjust the outlet clearance. The contact portion 732 then also moves. At this time, the tension rod 73 moves together through the tension link 71 and the tension lever 72, so that the bias of the tension spring 74 is not substantially changed. Accordingly, it is unnecessary to reset the bias of the tension spring 74 when the outlet clearance is adjusted. The outlet clearance adjustment can be achieved simply in a short time.

(3) When the swing jaw 36 swings, the toggle plate 61 swings about the swing center S2 at the side of the toggle links 64. At this time, the swing centers S1 of the tension link 71 are positioned near the swing centers S2 at both sides of the toggle plate 61, the swings of the toggle plate 61 and the tension link 71 are approximate to each other. That is, the tension link 71 swings about the swing center S1 on the side of the tension lever 72 as the center of the swing, and the position of the tension lever 72 is not changed substantially. Accordingly, the tension spring 74 does not substantially expand or contract, but stable bias can be attained.

Note that the present invention is not limited to the embodiment described above but includes modifications and changes as far as the objects of the invention are achieved.

Figure 9:
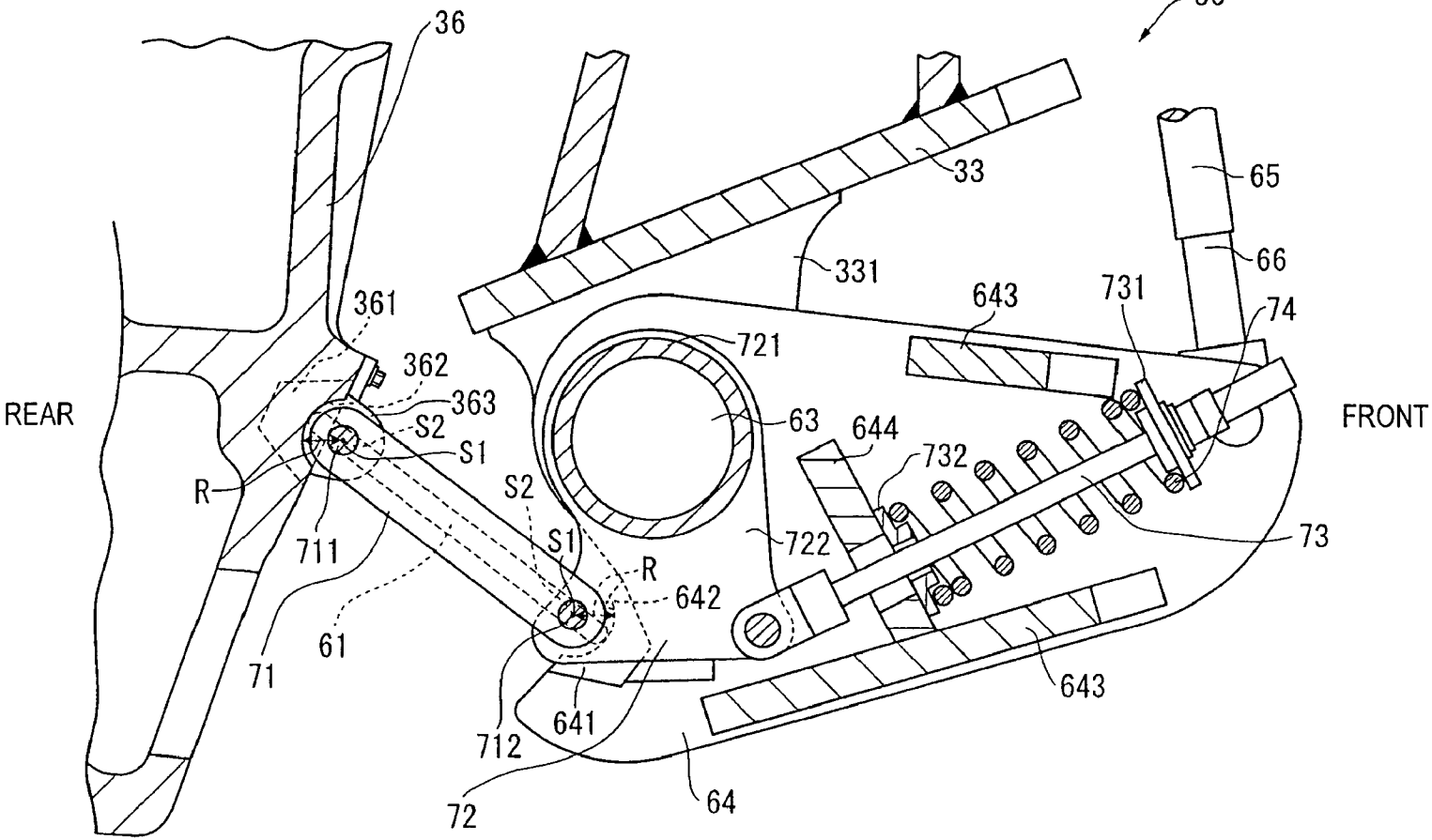
FIG. 9 is an enlarged sectional view showing a modified toggle plate holder mechanism.
Figure 10:
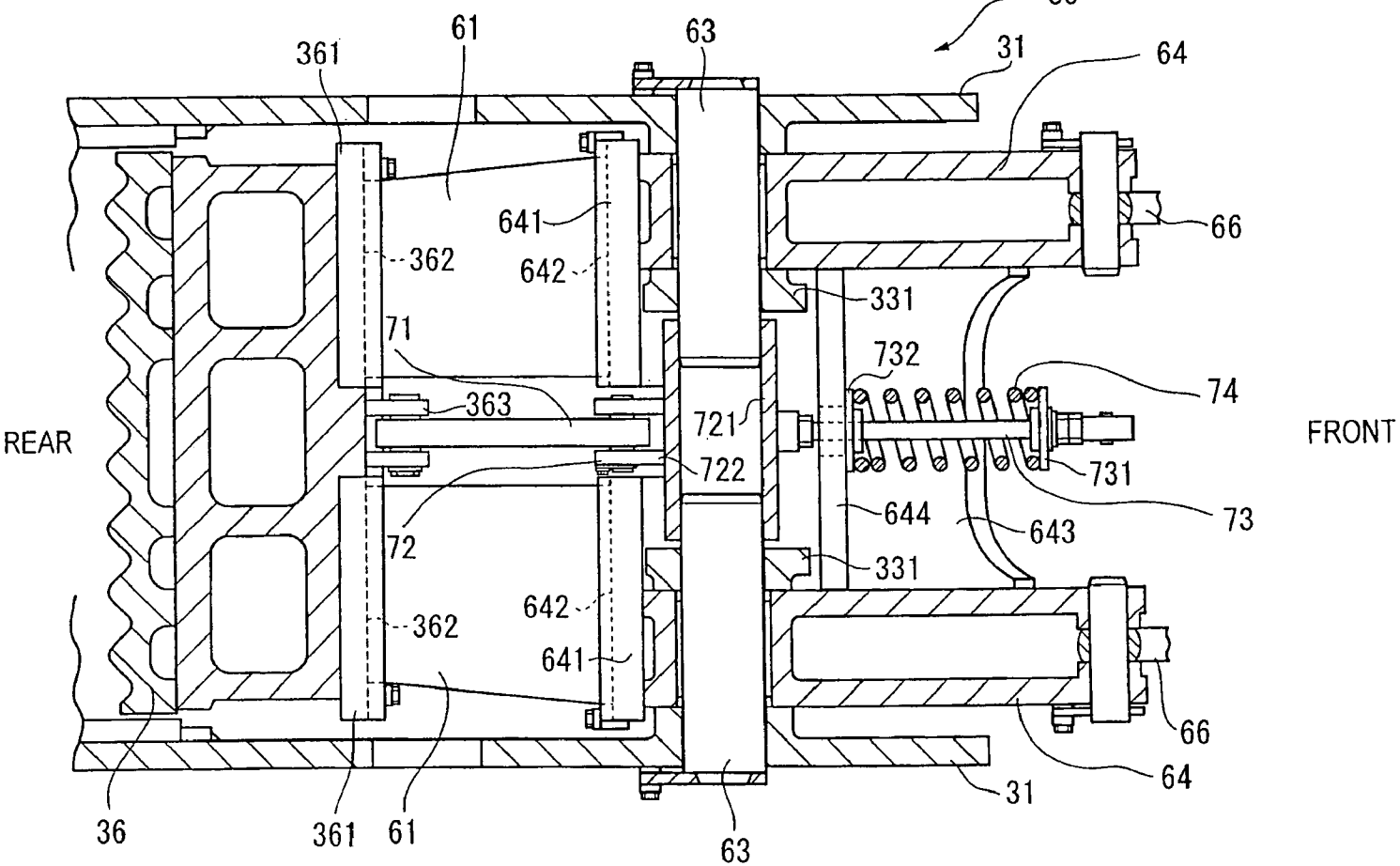
FIG. 10 is a plane sectional view showing the toggle plate holder mechanism of FIG. 9.

For example, the swing centers S1 of the tension link 71 are positioned near the swing centers S2 at both sides of the toggle plate 61. The present invention is not limited hitherto. As shown in FIGS. 9 and 10, the swing centers S1 may be at the same positions as the swing centers S2 at both sides of the toggle plate 61, when viewed in profile. In FIGS. 9 and 10, the tension link 71 is formed linearly in the longitudinal direction and is positioned in the substantial center in the width direction of the swing jaw 36. The toggle plate 61 is divided at the substantial center where the tension link 71 is positioned into two pieces each of which is sandwiched between the contact portions 361 and 641.

According to this structure, the swing centers S1 of the tension link 71 can be arranged at the same positions as the swing centers S2 of the toggle plate 61, when viewed in profile. Therefore, when the swing jaw 36 swings, the tension link 71 behaves in the same manner as the swing of the toggle plate 61. Accordingly, when the swing jaw 36 swings, the tension link 71 swings about the swing center S1 on the side of the tension lever 72 but the tension lever does not rotate at all. Therefore, the bias of the tension spring 74 does not change at all, so that more stable bias can be attained.

Note that the toggle plate 61 need not be divided into only two pieces but may be divided into a number of pieces corresponding to the number of provided tension link mechanisms.

Figure 11:
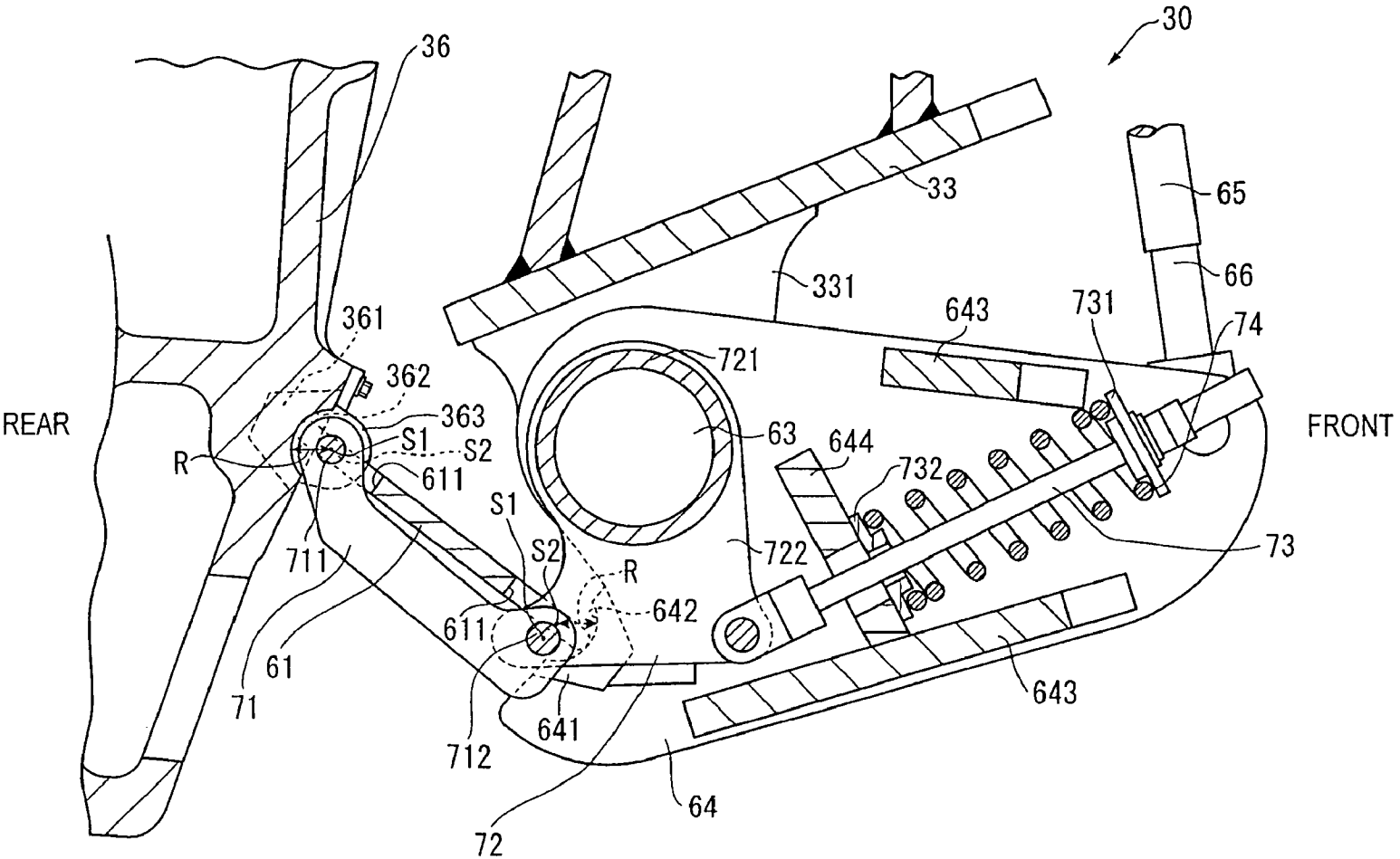
FIG. 11 is an enlarged sectional view showing another modified toggle plate holder mechanism.
Figure 12:
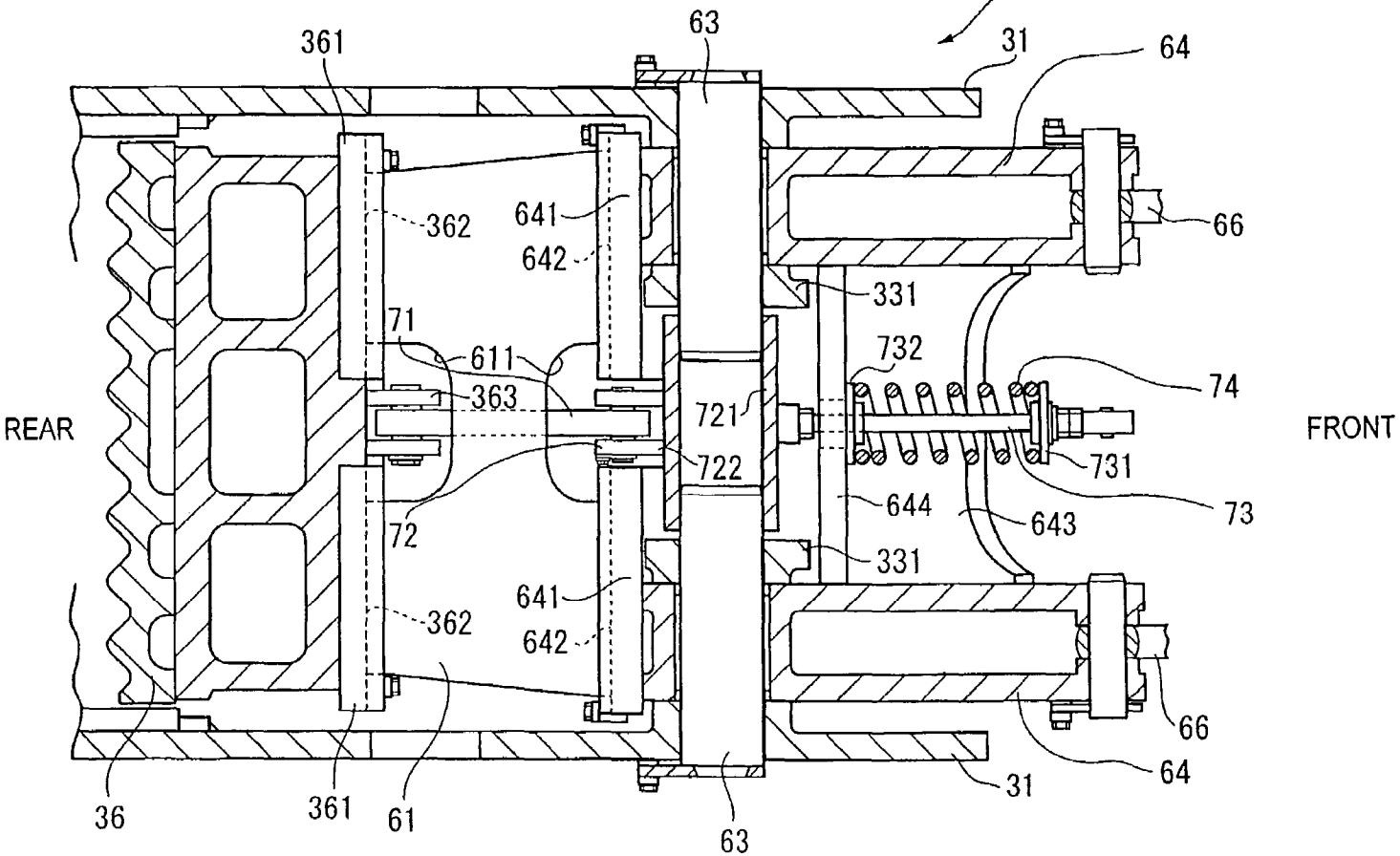
FIG. 12 is a plane sectional view showing the toggle plate holder mechanism of FIG. 11.

Alternatively, as shown in FIGS. 11 and 12, notches 611 may be provided respectively at the both sides of the toggle plate 61, and the both ends of the tension link 71 may be positioned inside these notches 611. In FIGS. 11 and 12, notches 611 are formed on both ends of the toggle plate 61 at the substantial center of the toggle plate 61 in its width direction. Both ends of the tension link 71, which has a shape having a concave when viewed in profile, are positioned inside these notches 611. At an end of the tension link 71, the swing center S1 on the side of the swing jaw 36 is at the same position as the swing center S2 of the toggle plate 61, when viewed in profile. The other swing center S1 on the side of the tension lever 72 is positioned near a swing center S2 of the toggle plate 61, when viewed in profile. According to this structure, the swing centers S1 can be located near the swing centers S2 of the toggle plate 61 or at the same positions as the swing centers S2, when viewed in profile, without causing interference between both ends of the tension link 71 and the toggle plate 61. Thus, the bias of the tension spring 74 can be stabled. Also according to this structure, the notches 611 are formed in the toggle plate 61, so that the swing jaw 36 can be supported by the one single toggle plate 61 throughout the overall width of the jaw 36. Therefore, one-sided abrasion of the toggle plate 61 can be prevented from occurring even from a long-time use. The durability of the toggle plate 61 can thus be improved.

In the structure shown in FIGS. 9 and 10, the positions of the swing centers S1 may both be near the swing centers S2 of the toggle plate 61, or only one of the swing centers S1 may be located near one of the swing centers S2. Also in FIGS. 11 and 12, both of the swing centers S1 may be near the swing centers S2 or may be at the same positions as the swing centers S2 when viewed in profile. Alternatively, on the contrary to these figures, the swing centers S1 may be located near the swing centers S2 or at the same positions as the swing centers S2 when viewed in profile.

Figure 13:
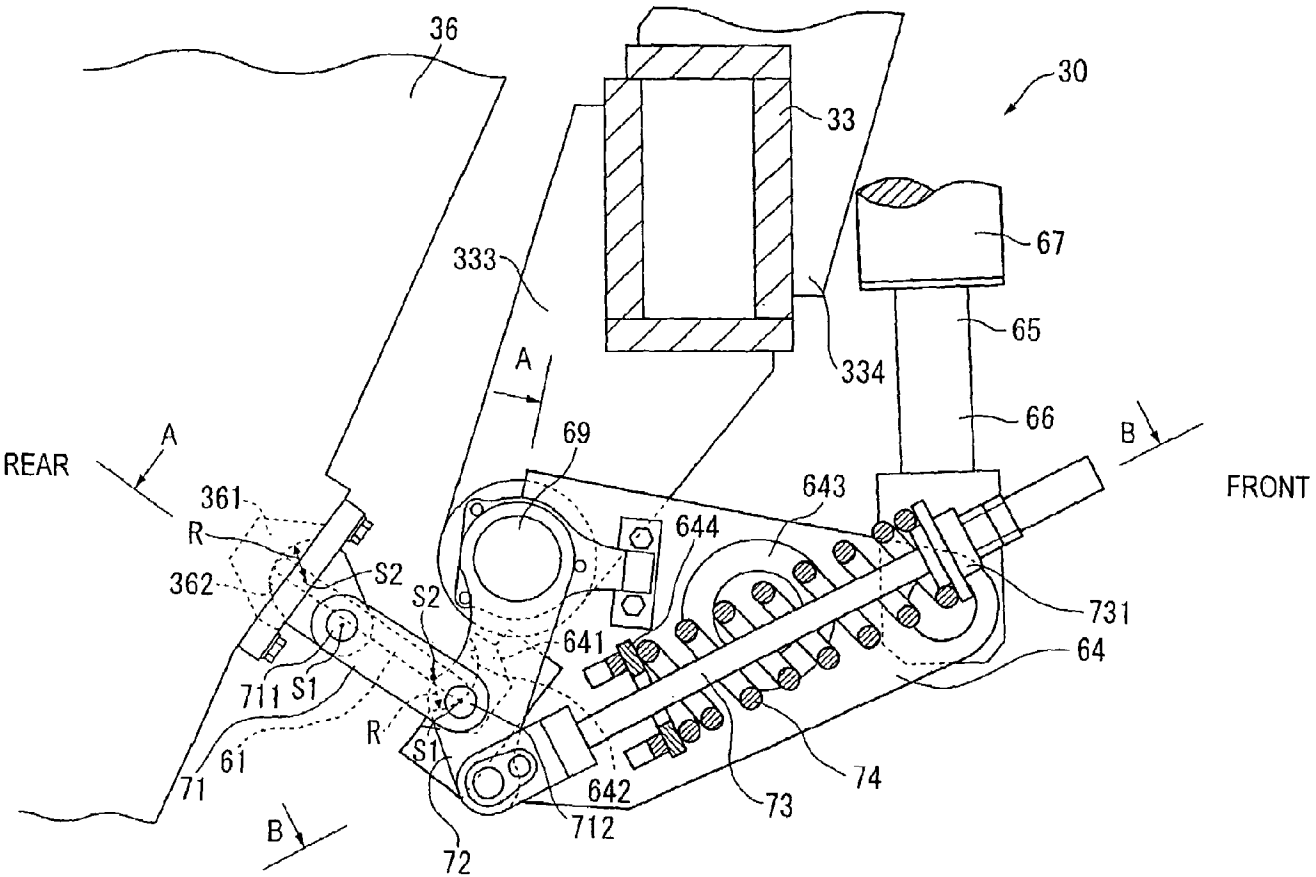
FIG. 13 is an enlarged sectional view showing a further modified toggle plate holder mechanism.
Figure 14:
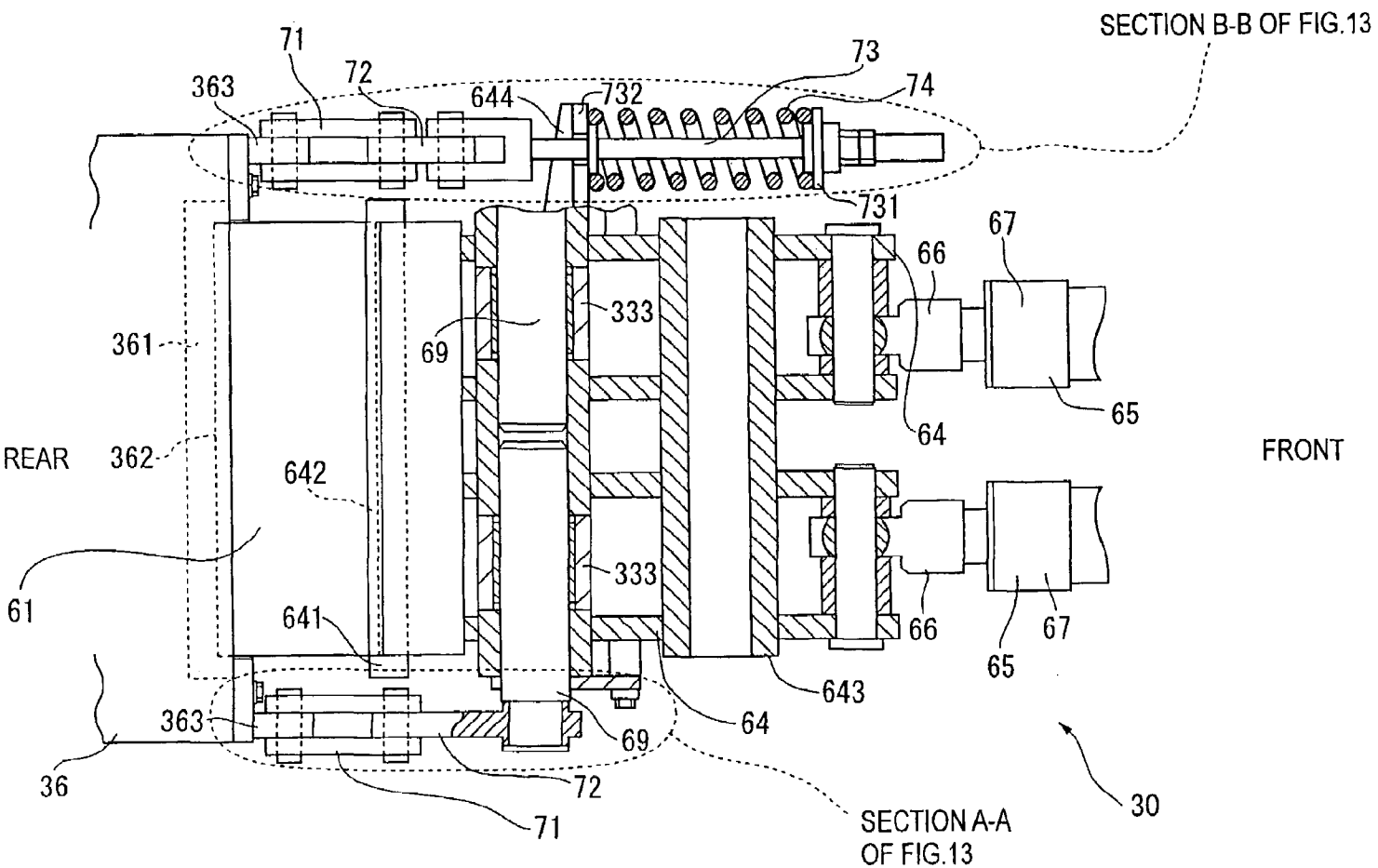
FIG. 14 is a plane sectional view showing the toggle plate holder mechanism of FIG. 13.

The tension link mechanism is provided in the substantial center of the swing jaw 36 in its width direction. However, as shown in FIGS. 13 and 14, a pair of tension link mechanisms may be provided on both sides of the toggle plate 61. In FIGS. 13 and 14, the toggle links 64 are provided close to each other, and are linked to each other by a cylindrical link portion 643. The toggle links 64 are fixed to a rotation link pin 69. Therefore, the rotation link pin 69 rotates together with toggle links 64. The rotation link pin 69 is rotatably supported by mount portions 333 each of which has a substantially center portion protruding below the cross member 33.

The tension levers 72 are supported individually rotatably by the rotation link pin 69. The tension rod 73 is supported by a mount portion 644 protruded from the toggle links 64 through a tension spring 74.

The bear lock cylinders 65 are rotatably supported by the mount portions 334 protruded upward from the cross member 33, on the far side of the cylinder bodies 67 from the rods 66, i.e., on the bottom side of the cylinder bodies 67.

In the jaw crusher having this structure, the tension link mechanism includes links. Therefore, the tension rod 73 and the tension spring 74 do not protrude to the side of the discharge conveyor 50 and excellent discharging performance can be achieved. When the rods 66 of the bear lock cylinders 65 are extended and retracted, the toggle links 64 rotate together with the rotation link 69, so that the outlet clearance W between the swing jaw 36 and the fixed jaw 35 can be adjusted like the foregoing embodiment. At this time, since the tension spring 74 is attached to the toggle links 64, the bias does not substantially change even if the outlet clearance is adjusted. It is hence unnecessary to adjust the bias, and the outlet clearance adjustment can be achieved easily.

The jaw crusher 30 according to the present invention has been described to be mounted on the self-propelled crushing machine 1. However, the present invention is not limited hitherto but the jaw crusher 30 may be used as a permanently fixed type. Also in this case, the tension rod 73 and the tension spring 74 can be structured so as not to interfere with the discharge conveyor 50 without increasing the overall height. Excellent discharging performance can hence be achieved.

[Other Embodiments]

The best structures and methods to practice the present invention have been disclosed in the description above. The present invention however is not limited to the description. Although the present invention has been illustrated and described mainly based on a specific embodiment, a skilled person in the art will be able to variously modify the embodiment described above with respect to shapes, materials, quantities, and any other structures of components constituting the present invention, without deviating from the scope of the technical ideas and objects of the invention.

Therefore, those parts of the above description that disclose shapes, materials, and the like are merely examples which help understanding of the present invention and do not limit the scope of the present invention. The present invention includes such description that uses names excluding part or all of limitations to those shapes, materials, and the like.

What is claimed is:

1. A jaw crusher comprising:

a fixed jaw;

a swing jaw which swings relative to the fixed jaw;

a reaction force receiver mechanism comprising: (i) a toggle plate that is angled upward toward the swing jaw and includes a first end that contacts the swing jaw, and (ii) a toggle plate support member that contacts a second end of the toggle plate; and a toggle plate holder mechanism which comprises: (i) a link member that holds the toggle plate between the swing jaw and the toggle plate support member, and (ii) a biasing portion which is coupled to the toggle plate support member and which biases the swing jaw and the toggle plate support member to the toggle plate;

wherein the reaction force receiver mechanism comprises an outlet clearance adjustment mechanism which moves the swing jaw with respect to the fixed jaw to adjust an outlet clearance between the jaws by adjusting a position of the toggle plate support member and the toggle plate;

wherein the link member comprises a tension link including a first end coupled to the swing jaw, and the toggle plate holder mechanism further comprises:

a tension lever supporting a second end of the tension link;

a tension rod having an end attached to the tension lever; and a tension spring which biases the tension rod in an axial direction of the tension rod, said biasing portion comprising the tension spring; and wherein swing centers at two sides of the tension link are positioned in a vicinity of swing centers at two sides of the toggle plate.

2. The jaw crusher according to claim 1, wherein the swing centers at the two sides of the tension link are located at same positions as the swing centers at the two sides of the toggle plate, when viewed in profile.

3. The jaw crusher according to claim 1, wherein the tension link has a concave shape in profile, and notches are formed in the toggle plate at respective positions corresponding to the swing centers at the two sides of the tension link.

4. The jaw crusher according to claim 2, wherein the tension link has a concave shape in profile, and notches are formed in the toggle plate at respective positions corresponding to the swing centers at the two sides of the tension link.

5. The jaw crusher according to claim 1, wherein the toggle plate is divided into a plurality of pieces such that at least one of the pieces is provided on each side of the tension link.

6. A self-propelled crushing machine on which the jaw crusher according to claim 1 is mounted.

7. The jaw crusher according to claim 2, wherein the toggle plate is divided into a plurality of pieces such that at least one of the pieces is provided on each side of the tension link.

* * * * *